United States Patent [19]

Logue et al.

[11] 4,043,813

[45] Aug. 23, 1977

[54] PHOTOCONDUCTIVE PARTICLES OF ZINC OXIDE

[75] Inventors: Daniel R. Logue, Upland; Terry G. Anderson, Pasadena, both of Calif.

[73] Assignee: Bell & Howell Company, Chicago, Ill.

[21] Appl. No.: 594,150

[22] Filed: July 7, 1975

Related U.S. Application Data

[63] Continuation of Ser. No. 367,668, June 6, 1973, abandoned.

[51] Int. Cl.[2] ..... G03G 5/08; G03G 5/04

[52] U.S. Cl. ..... 96/1.8; 96/1.5 N; 252/501

[58] Field of Search ..... 96/1.8, 1.5, 1.7; 252/501

[56] References Cited

U.S. PATENT DOCUMENTS

| | | | |
|---|---|---|---|
| 3,352,670 | 11/1967 | Coles | 96/1.7 |
| 3,634,333 | 1/1972 | Tamai | 96/1.5 |
| 3,652,276 | 2/1972 | Bartlett | 96/1.7 |
| 3,658,523 | 4/1972 | Noe | 96/1.8 |
| 3,754,906 | 8/1973 | Jones et al. | 252/501 |
| 3,801,316 | 4/1974 | Bowman | 96/1.5 |
| 3,904,409 | 9/1975 | Hanada et al. | 96/1.8 |

*Primary Examiner*—Edward C. Kimlin

*Attorney, Agent, or Firm*—Nilsson, Robbins, Dalgarn & Berliner

[57] ABSTRACT

An improved photoconductive surface coating is provided having panchromatic sensitivity and increased resistance against spectral response shift upon reuse of the photoconductive layer. The surface coating comprises zinc oxide particles, a minor amount of a group IIB selenide or telluride and a binder in substantially uniform mixture. The selenide or telluride is chemically deposited on the zinc oxide particles. The resulting particles exhibit bi-chargeability and substantially increased light sensitivity. The selenide or telluride can be deposited chemically in accordance with one embodiment by dispersing zinc oxide particles in a medium such an water and precipitating the selenide or telluride, preferably in situ, on the surface of the particles.

2 Claims, 2 Drawing Figures

PHOTOCONDUCTIVE PARTICLES OF ZINC OXIDE

This is a continuation, of application Ser. No. 367,668, filed June 6, 1973 now abandoned.

BACKGROUND AND SUMMARY OF THE INVENTION

Photoconductive materials are extensively used in electrophotography and the like. For example, it is conventional to electrostatically charge a surface of such photoconductive material and then expose the charged surface to a light pattern so as to selectively discharge the areas of the surface impinged upon by the light pattern. The electrostatic pattern remaining on the photoconductive surface forms a latent image which can be sensed electronically or made visible by contact with a suitable developer such as charged toner particles or the like. The developed image on the photoconductive surface can be used as the finished copy or can be transferred (printed off or the like) to one or more copy sheets. Commercial usage of such processes is growing and there is a continuing need for faster, less expensive components capable of producing high resolution copies.

Various types of photoconductive materials have been used for such purposes, including sulfur, selenium, zinc sulfide, antimony oxide, cadmium sulfide, lead sulfide, anthracene, anthraquinone and other organics, in the form of coated sheets, plates, drums, etc. One of the most widely used of such photoconductive materials is white zinc oxide in particulate form dispersed in a binder so as to provide a photoconductive coating on a suitable conductive substrate such as paper or the like. The binder usually is an insulating medium. A surface coating of such zinc oxide particles in a binder has many advantages, including the fact that it is relatively inexpensive and easily made and can be used, together with the underlying substrate, as the finished copy sheet.

Prior art of interest includes U.S. Pat. Nos. 2,710,813, 2,971,859, 3,121,007, 3,152,894, 3,178,312, 3,346,381, 3,347,702, 3,428,452, 3,466,183, 3,467,497, 3,573,906, 3,607,363, 3,634,134, 3,634,333, 3,636,492, 3,658,523 and 3,647,430 and Canadian Pat. Nos. 639,318 and 678,917.

Zinc oxide-containing photoconductive coatings have some drawbacks. For example, zinc oxide is most sensitive to light in the ultraviolet region, with a peak around 385 nm. However, it is desirable for many purposes to utilize visible light in connection with the production of the latent electrostatic image in the photoreproduction process. Accordingly, various types of organic sensitizing dyes have been added to zinc oxide to shift (and broaden) its spectral response into the visible light spectrum. Although these dyes generally initially perform satisfactorily, upon repeated exposure, the dye tends to undergo irreversable photo-destruction, resulting in a decrease in concentration and shift in spectral response, decreasing in visible light sensitivity while increasing in ultraviolet sensitivity. Since a fixed light source is used in the copying process, the visible images produced will show changes in density and contrast from copy to copy over a period of time as the spectral response shifts.

Accordingly, there has been a need for a relatively inexpensive photoconductive layer which would have all the advantages of organic dye sensitized zinc oxide but which would, in addition, be stable against spectral response shift upon repeated usage of such a layer. It would also be desirable if the light sensitivity of such a layer could be increased. It would further be desirable to render the coating bi-chargeable, that is, capable of being either negatively charged or positively charged, depending on the desired application, type of toner to be employed and other factors.

The foregoing needs have now been satisfied by the improved photoconductive layer embodiments of the present invention and by the method herein of providing photoconductive particles. In accordance with the present invention, a relatively minor amount of a sensitizer compound comprising one or more of certain Group IIB–VIA compounds is combined with zinc oxide and greatly increases the spectral response of zinc oxide so as to make it panchromatic. Moreover, this response is not subject to material degradation during reuse of the coating even over a great many exposures of the photoconductive layer. The Group IIB–VIA sensitizer compounds suitable for use herein are those compounds in which the VIA moiety has an energy band of less than 2.1 electron volts; i.e., selenium and tellurium. Thus, the additive compounds are zinc selenide, zinc telluride, cadmium selenide, cadmium telluride, mercuric selenide and mercuric telluride. The cadmium compounds are preferred and particularly cadmium selenide.

The present method of obtaining the improved photoconductive particles for use in the layer is simple and the layer is very inexpensive to make and is easily reproduced. When the sensitizer compound is chemically deposited as a coating on the surface of each of the zinc oxide particles, the resulting particles are bi-chargeable with approximately equal response in the positive and negative modes. Moreover, such particles exhibit greatly increased light sensitivity while still providing high resistance to spectral response shift. Further advantages of the present invention are set forth in the following detailed description and accompanying drawings.

DRAWINGS

FIG. 1 schematically depicts in enlarged cross-section a portion of one embodiment of the improved photoconductive layer of the present invention; and FIG. 2 schematically depicts in greatly enlarged form one of the photoconductive particles present in the photoconductive layer of FIG. 1.

DETAILED DESCRIPTION

Figure 1:
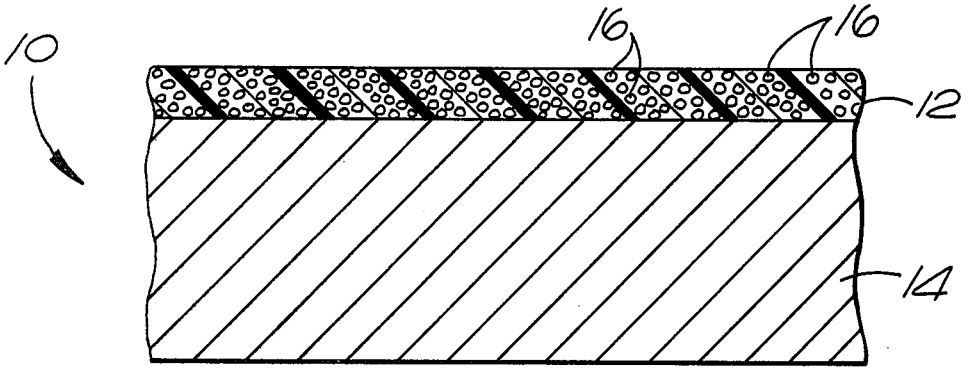
Figure 2:
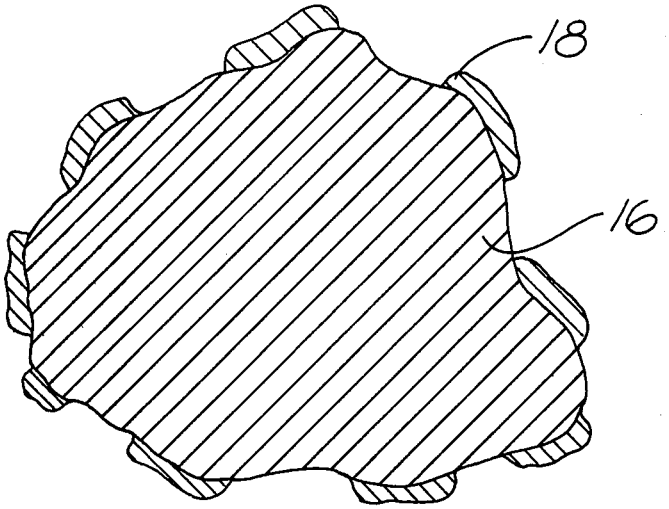

A preferred embodiment of the invention is shown schematically in FIG. 1 depicting an improved photoconductive layer 10 of the invention which comprises a photoconductive surface coating 12 disposed on a conductive substrate 14. The coating comprises a plurality of zinc oxide particles 16 substantially uniformly dispersed throughout a matrix of coalesced binder particles. As a key feature of this embodiment of the invention, the surface coating also includes a sensitized compound as described above which, in this exemplary embodiment, is cadmium selenide. As shown in FIG. 2, the cadmium selenide is present as a surface deposit 18 on each zinc oxide particle, and preferably as a discontinuous layer.

The zinc oxide utilized in the described surface coating 12 can be any suitable grade of white photoconductive zinc oxide. It is usually present in finely divided form, having an average particle diameter size range of about 0.1 to about 0.4 microns, preferably 0.18–0.35 microns, and most preferably, about 0.3 microns. However, other particle size ranges are also suitable.

It will be noted from FIG. 2 that the cadmium selenide coating on the zinc oxide particles is relatively thin. Normally, its thickness is not in excess of about 500 Angstroms and usually substantially less, varying in most instances between about 100 and about 300 Angstroms. Only a thin coating of the cadmium selenide is necessary to achieve the desired results. Thicker coatings can also be used but usually are not desired since they tend to mask the desirable properties of the zinc oxide and are more expensive and time-consuming to produce. The finished particles depicted in FIG. 2 have a tannish color due to the thin surface layer of the cadmium selenide on the white zinc oxide particles.

The sensitizer coated zinc oxide particles are mixed with a binder in a waring blender or the like, following or proceeding ball milling, etc.

The binder used in the surface coating 12 is usually present in the coating in an amount less than that of the combined weight of the zinc oxide plus cadmium selenide and, preferably, is in a weight ratio of about 1:2 – 1:10, most preferably, about 1:8, although other ratios are suitable. Such binder material may be any suitable thermosetting and/or thermoplastic resinous materials, such as phenolic resin, polyester resin, alkyd resin, polyvinyl chloride, silicone resins, epoxy and amino resins and the like, all as evident to those skilled in the art.

In the case of thermoplastic resins, particles of the binder can be mixed with the photosensitive particles to provide a uniform dispersion, after which the mixture can be evenly spread on the substrate 14 and then heated sufficiently to cause coalescing of the binder particles with each other, with the substrate and with the zinc oxide and sensitizer particles and sensitizer-coated zinc oxide particles to form the continuous uniform surface coating 12. Alternatively, the thermoplastic resin can be heated to above its softening point before mixing with the particles, then spread as the surface coating on the substrate and allowed to cool and solidify. When using thermosetting resins as the binder, but also with thermoplastic resin binders, a solvent for the binder can be used to soften or dissolve the binder so as to effect the desired coalescing, after which the surface coating is formed and the solvent is then evaporated to set the surface coating. Such solvent may be toluene, benzene and the like organic solvents, the type of solvent depending on the particular resin system employed, all as evident to those skilled in the art.

In accordance with one embodiment herein, the sensitizer compound can be provided as a chemical deposit on the zinc oxide particles by dispersing the zinc oxide particles in a suitable liquid medium such as water (as by slurrying the particles with agitation) and, while the particles are so dispersed, chemically depositing the sensitizer compound on the particles.

The described procedure can best be achieved by in situ forming the sensitizer compound in the medium and precipitating it therefrom. The medium is selected such that the sensitizer compound is insoluble therein so that as the sensitizer compound is formed it precipitates from the medium and deposits out in finely divided form on the zinc oxide, building up thin islands on the particles. For such purposes, it is desirable to use a salt of the Group IIB components which is soluble in the medium, for example, cadmium chloride, zinc chloride or mercuric acetate, which are soluble in water. Moreover, a material which yields divalent selenide or telluride (as desired) ions, in the medium, in this case, water, is also used. One such suitable selenium-yielding material is selenourea. Selenourea has the general formula $H_2NCSeNH_2$. It decomposes in water, heat-speeding the decomposition. Other suitable, water soluble selenide or telluride ion-yielding materials can be used, for example, selenium hydride, tellurium hydride, sodium selenide or sodium telluride.

In an exemplary embodiment of the present method wherein cadmium selenide is to be deposited, zinc oxide particles are slurried in water, whereupon cadmium chloride is added, along with selenourea, both in concentrations sufficient to provide cadmium selenide in an amount adequate to chemically coat the island structure on the zinc oxide particles to the desired thickness. The slurry is continuously agitated and heated to about 90° C to speed the decomposition of the selenourea. After a suitable contact period, for example, 2 hours, during which the cadmium selenide is formed and precipitated on the zinc oxide, stirring of the slurry is discontinued and the mixture is allowed to cool and settle, whereupon the cadmium selenide-coated zinc oxide particles are washed, filtered and recovered for use in the formation of the improved photoconductive layer of the present invention. Such particles can be mixed with the binder and any binder solvent, ball milled, and then coated on the substrate 14 to form the photoconductive surface coating 12 in the photoconductive layer 10 of the invention.

The substrate 14 may be any suitable material, for example, a conductive bond paper, cellulose acetate, polyamide foil, etc. or a metal plate of zinc, aluminum, brass or the like, all as known to the art. Preferably, the substrate is inexpensive, flexible and disposable. The surface coating 12 is present on the substrate in any suitable coating thickness at least sufficient to achieve the desired results. For example, it has been found that coating thicknesses of about 0.5 to about 1.5 mils can be used, preferably about 0.8 to about 1.0 mils. Other suitable thicknesses can also be employed.

The finished photoconductive layer of the invention exhibits panchromatic light sensitivity, can be reused thousands of times without exhibiting significant spectral response shift, and is relatively inexpensive. In the case of those surface coatings employing the sensitizer compound as thin islands on each zinc oxide particle rather than having it merely physically mixed as discrete particles along with the zinc oxide particles, bichargeability of the surface coating is achieved, together with a great increase in the light sensitivity, up to 1000 times, over that of conventional zinc oxide particle photoconductors. Certain aspects of the present invention are further illustrated by the following specific Examples.

EXAMPLE I

To a 500 ml. volume of demineralized water are added 50 g. of photoconductive zinc oxide powder (average diameter 0.3 microns), 0.5 g. of anhydrous cadmium chloride and 1.0 g. of selenourea. The cadmium chloride dissolves in the water while the selenourea decomposes in the water at ambient temperature. The mixture is agitated to form a slurry and is heated at 90° C. for 40 minutes (while maintaining agitation) to insure complete decomposition of selenourea. As the selenourea decomposes, the dispersion color changes from white to reddish tan due to formation of cadmium selenide and its precipitation onto the surface of the zinc oxide particles. The mixture is then allowed to settle and cool after which the supernatant fluid is withdrawn (after 2 hours settling time) and the remaining solids collected, filtered, redispersed in water, refiltered, washed with methyl alcohol, refiltered twice and finally dried at 110° C. for three hours. The resulting powder is light tan in color.

Powder made in accordance with the procedure described above is then tested utilizing the coatings as set forth in Table I below. In each instance, in producing a coating to be tested, the ingredients are suspended in toluene and rolled on a ball mill for 4 hours before being applied to the surface of conductive paper based stock, as a thin film which is then dried in air to remove the toluene. The coating thickness in each instance is 12–15 microns. Two separate runs are made utilizing the following coatings.

Table I

| Run | ZnO-CdSe* | ZnO | CdSe | Phenolic Resin Binder |
|---|---|---|---|---|
| 1 | 0 | 15 g. | 0 | 3 g. |
| 2 | 0 | 14.85 g. | 0.145 g. | 3 g. |
| 3 | 7.5 g. | 7.5 g. | 0 | 3 g. |
| 4 | 15.0 g. | 0 | 0 | 3 g. |

* Material made in accordance with the method set forth in this Example:

The separate coatings of Runs 1–4 are evaluated by a device which corona charges the surface coating, measures the charge acceptance of the coating, permits a dark decay, then exposes and measures the amount of light required to discharge the surface coating. The apparatus cycles automatically.

The test results on the compositions of Runs 1–4 indicate that the charge acceptance for coatings formed from a mixture of the zinc oxide and cadmium selenide and coatings formed from deposited zinc oxide-cadmium selenide (Runs 2, 3 and 4) varies between 320 and 650 volts, depending on coating thickness and the concentration of zinc oxide and cadmium selenide present in the coating. The dark decay rate for such coatings is the same as for untreated zinc oxide (Run 1). Moreover, the coatings of Runs 3 and 4 are bi-chargeable with essentially the same magitude of chargeability for positive and negative charges, whereas the coatings of Runs 1 and 2 are not bichargeable.

The coatings of Runs 3 and 4 are about 1000 times faster than the coating of Run 1, in both the positive and negative charge modes. Moreover, the coatings of Runs 2, 3 and 4 show little sign of fatigue with prolonged use. For example, the coating of Run 4 was used 2800 times with no substantial degradation, i.e. no substantial spectral response shift.

EXAMPLES II–VI

The procedure of Example I can be followed but substituting for the cadmium chloride and selenourea, equal amounts of the following Group IIB salt and Group VIA compound:

| Example | Group IIB Salt | Group VIA Compound |
|---|---|---|
| II | Zinc Chloride | Selenourea |
| III | Mercuric Acetate | Selenourea |
| IV | Cadmium Chloride | Tellurium Hydride |
| V | Zinc Chloride | Tellurium Hydride |
| VI | Mercuric Acetate | Tellurium Hydride |

The foregoing Examples clearly demonstrate that the improved photoconductive layer of the present invention, whether incorporating the sensitizing compound in the form of discrete particles uniformly mixed with zinc oxide or in the form of a coating layer on the surface of the zinc oxide particles, exhibits panchromaticity while resisting, over a great number of exposures of the layer to light, any substantial shift in spectral response. Moreover, when the sensitizing compound is disposed as a coating on the zinc oxide particles, greatly increased light sensitivity is exhibited, together with bi-chargeability, the coating showing substantial chargeability in either the negative or the positive mode. The present method of providing such a coating on the zinc oxide particles is simple, rapid, inexpensive and reproducible. Moreover, the finished photoconductive layer is also inexpensive to produce and use. Other advantages of the present invention are as set forth in the foregoing.

What is claimed is:

1. An improved photoconductive material having a surface coating comprising zinc oxide particles, sensitizer compound and an insulative binder, said sensitizer compound comprising a compound selected from the group consisting of cadmium selenide, cadmium telluride, zinc selenide, zinc telluride, mercuric selenide and mercuric telluride, said sensitizer compound being present in a concentration of at least about 0.5% and not in excess of about 10% by weight of the total concentration of zinc oxide plus sensitizer compound as a surface deposit on and strongly adhered to the surface of said zinc oxide particles in the form of substantially discontinuous islands on each said particle, said islands having an average thickness of between about 100 and 500 Angstroms, whereby said layer has increased light sensitivity, resists shifts in spectral response during reuse, and has a bi-chargeability.

2. The improved photoconductive material of claim 1 wherein said binder is present in said surface coating in a weight ratio to said zinc oxide plus said sensitizer compound between about 1:2 and about 1:10.

* * * * *